United States Patent [19]

Foley et al.

[11] 4,025,715

[45] May 24, 1977

[54] SHIELDED ELECTRIC CABLE

[75] Inventors: Dennis D. Foley, Cheshire, Conn.; John N. Reynolds, Williamsport, Pa.

[73] Assignee: Alcan Aluminum Corporation, Cleveland, Ohio

[22] Filed: Mar. 15, 1976

[21] Appl. No.: 666,743

[52] U.S. Cl. ..... 174/36; 174/108; 174/115; 174/120 SC

[51] Int. Cl.[2] ..... H01B 11/06; H01B 7/18

[58] Field of Search ..... 174/36, 102 SC, 108, 174/113 R, 115, 120 SC

[56] References Cited

UNITED STATES PATENTS

| | | | |
|---|---|---|---|
| 1,832,455 | 11/1931 | Gilbert | 174/108 X |
| 1,873,470 | 8/1932 | Peek, Jr. et al. | 174/108 |
| 2,320,313 | 5/1943 | Thomas et al. | 174/36 X |
| 2,604,509 | 7/1952 | Blanchard | 174/108 |
| 3,351,706 | 11/1967 | Gnerre et al. | 174/108 X |
| 3,735,025 | 5/1973 | Ling et al. | 174/120 SC |
| 3,876,462 | 4/1975 | Carini et al. | 174/120 SC |

*Primary Examiner*—Arthur T. Grimley
*Attorney, Agent, or Firm*—Cooper, Dunham, Clark, Griffin & Moran

[57] ABSTRACT

Shielded electrical cable of the high voltage type having a central conductor with a semiconducting coating surrounded by polymeric insulation, has a shielding assembly that includes a semiconducting layer around the insulation and a multiplicity of aluminum wires which can be grounded, which are individually coated with semiconducting material, and which are arranged in a long helical wrapping around the coated insulation in relatively close spacing to each other. This structure, especially useful underground, provides very effective shielding and fault-current return paths, with a relatively inexpensive aluminum structure that is nevertheless protected from corrosion. There are also advantages of better mechanical protection and less likelihood of cable damage by differential temperature expansion effects.

15 Claims, 2 Drawing Figures

SHIELDED ELECTRIC CABLE

BACKGROUND OF THE INVENTION

This invention relates to shielded electric cable, especially cable designed for high voltage service, notably service requirements at about 2000 volts and above, of which particularly important examples are in the range of approximately 5000 volts and upwards. The present cable is capable of use in electrical power circuits operating indoors, aerially, or particularly underground. In a more specific sense, the invention is concerned with cable of the type that includes a central power conductor, whether a single metal element or most usually a multiplicity of metal strands or wires twisted in a unified configuration, having a solid, space-filling layer of semiconducting material around it and tightly surrounded by insulation, e.g., a thick insulating body of polymeric material (for instance, extruded or molded in place), which is in turn closely jacketed or coated with semiconducting material for protective shielding function.

In cables of this type, it has been found unusually important to protect the insulation from the effects of electrical discharge, for instance as might occur in the nature of corona discharge in even small air gaps adjacent to the outermost surface of the electrical conductor element, whether of the single or multiple type, or in the immediate vicinity of localities around the exterior of the insulation. This protection is especially important when the insulation consists of one of various polymers now employed for such purposes, for example polyethylene, polypropylene, or the like, because discharges of this type, involving intensely ionized paths, can be seriously damaging to the insulation, by reason of chemical breakdown, gas release, or other fracture or fissure in the insulating structure, due to the heat and impact of the discharge. The consequence of such damage to the heavy, solid, insulating layer is the hazard that the insulation will fail in its function, causing breakdown of the power line.

To inhibit occurrence of these effects, especially in the case of the monolithic polymer bodies of insulation, the above coatings of semiconducting material, of plastic composition solidified in place, have been applied to the outer surface of such insulation, and also to the outside of the electrical conductor unit, covering it and filling the outer interstices between wire strands, before it is coated with the chief insulation. The function of the semiconducting materials, which are composed of a similar polymeric base in which is dispersed a suitably large quantity of conducting substance such as carbon, is principally to substitute such material as a non-ionizing leakage path instead of air everywhere around the inside and outside of the insulation, as well as to reduce the effective electric field or to make it more uniform, along such surfaces. Thus the semiconducting layer can be considered to provide a non-ionizing, low resistance, leakage path, uniformly throughout these regions, so as to diminish or obviate the possibility of corona or like discharges.

As an important addition to structures of the foregoing sort, it has been the practice to apply an outer metallic assembly, such as a wrapping of one or more bare wires of copper or tinned copper spaced around the insulated and shielded cable, which in turn serves a further purpose for the protection of the cable and avoidance of undesired breakdown. This metallic structure can constitute further electrical shielding by affording a surrounding system of elements that exhibit a neutral or ground potential. It can also serve as a so-called drain conductor, e.g., for carrying any transient or sudden flow of current caused by unusual electrical disturbance which might otherwise produce complete breakdown of the insulation and lead to short circuit of the main conductor.

In some instances, it has been proposed that the outermost semiconducting layer have imbedded in it thin metallic ribbons or fine wires or the like, which may extend lengthwise of the cable, either in a wrapped or longitudinally parallel disposition, to constitute a metallic shield for purposes somewhat similar to those just described. While these relatively light aluminum or copper elements or similar structures which are thus encased in or covered by the outer semiconducting layer can serve, so to speak, as a ground plane, they may not be entirely adequate for draining a high fault current if such occurs.

With the previously mentioned outer wrapping of spaced, bare wires, the drain for fault current can be adequate, and indeed circumferential shield wires may even collectively serve as grounded-side, return service path for the electrical power circuit of which the central conductor is at high potential above ground. A single such cable assembly can thus provide single phase service. For three phase power transmission, using a group of three such assemblies, the outer wires can together constitute the common or neutral return for the system.

Another prior proposal has been to utilize a single large conductor coated with semiconducting material and wrapped around a main insulated power conductor of the same basic type as above, i.e., having an insulating layer provided with layers of semiconducting material under and over it. In such structure, the single, coated, outer conductor, which may be copper or aluminum, can serve effectively for the ground return of the power circuit, and it accommodates a high fault current effectively when such occurs, but it does not provide any uniformity or indeed efficacy of grounded or neutral structure for electrical shielding purposes. The single external conductor, moreover, affords relatively little mechanical protection in underground use; for instance during unguided digging in the vicinity of the buried cable, a digging implement could likely strike the insulated power conductor itself, with corresponding likelihood of direct damage to it.

As will be inferred from the foregoing, the present invention overcomes deficiencies of prior types of shielded cables such as have been mentioned above, particularly in respect to the nature and cooperative function of the outermost shielding structure. Furthermore, an important purpose of the invention is to achieve a simple, relatively less expensive cable design which affords superior results, especially in its protective features.

SUMMARY OF THE INVENTION

For improvement in shielded electric cable of the basic type described above, this invention comprises a novel construction and combination, namely: (1) a central, metallic conductor, surrounded by insulation, particularly a solid, thick body of polymeric material, having a layer or coating of semiconducting material around the outside of such body and also having a coating or covering of semiconducting material on the underlying conductor so as to separate the latter from the insulating wall but to have close contact with all outermost surfaces of the conductor as well as with the inside of the insulation; and (2) a shielding and protective assembly surrounding the polymeric insulation, such assembly consisting of the above layer of semiconducting material and a wrapping or layer of wire elements advantageously spaced close together around the cable circumference, wherein each wire element is an aluminum wire individually and substantially coated with semiconducting material that both protects the aluminum from corrosion and results in new electrical advantages for this shielding assembly.

Thus in coaction with the basic structure of the main, high potential, central power conductor and its covering layers of insulating and semiconducting material, the significant novel feature of this invention, instead for example of the common, prior, wrapped arrangement of bare copper or tinned copper wires, consists in the described multiplicity of semiconductor-coated aluminum wires wrapped in close spacing around and along the basic structure. There is a significantly large number of these elements, e.g., upwards of 10 or 12, even for cables having not much more than the minimum of electrical capability mentioned above, but most particularly the number and transverse dimensions of the coated aluminum wires is such that the spacing between them, i.e., between their outer surfaces, considered around the circumference of the cable in a direction perpendicular to the length of adjacent wire, is preferably not substantially more than the transverse outside diameter of each coated wire. Although in some cases these elements can be abutting, they may, and for economical construction should, be spaced apart, e.g., as described above. Indeed, the spacing between the exterior surface of each wire and such surface of each adjacent wire, i.e., the exterior of the coating on each, is very preferably less than the total outside diameter of each such coated element.

Cable structure so arranged and constituted has unusual advantages in electrical function and security of shielding as well as in protection from severity of damage by electrical incidents or mechanical accidents. These advantages are notably appropriate for underground, i.e., buried, situations of the cable where difficulties of shielding, moisture, possible short circuit and the like are particularly severe. Indeed, the semiconductor coating makes outer aluminum wires feasible underground, where corrosion of bare aluminum would normally prohibit its use. Similar or other advantages of the invention are also realized in aerial or other service, e.g., in protection against atmospheric electrical disturbances.

Considered generally, the total surrounding structure, consisting of the outermost layer of semiconductor on the insulating body together with the surrounding relatively thick members constituted by the semiconductor-coated aluminum wires, affords an unusually efficacious ground plane or enveloping, grounded body, which has effective uniformity all around the main insulated conductor. This is important in making sure that ground potential is substantially maintained and suitable ground path is available at all localities, especially taking account of the conductive aluminum wires and their own close spacing, and also their semiconductive coatings in cooperation with the semiconductive layer on the body of polymeric insulation.

In contrast, some cables have little or no such uniformity as to outer metallic elements, and even the prior structures using bare wires of copper, which are smaller in diameter, afford inherently less uniformity with the same number of such members as in the invention. Such structures, moreover, have the possibility of considerable incompleteness or irregularity of conductive envelope, in that the bare wires can sometimes easily slip sidewise or be accidentally so displaced, e.g., irregularly in a circumferential direction around the main insulated body. With the present invention, the outer shielding wire elements are relatively large and closely spaced and, because of their semiconducting coatings of plastic material, have little tendency to spread apart by inadvertent displacement.

As distinguished from prior structures where the conductive shielding and fault-current return path is purportedly achieved by thin aluminum tapes or ribbons, or widely spaced thin wires, imbedded in semiconducting material or otherwise arranged, the present cable affords a much more substantial path for draining fault current, which in some cases is expected to trigger electrically actuated protective devices, and also serves the function (only now obtainable with certain other prior constructions mentioned above) whereby a return circuit or path is constituted for the main power supply function. That is to say, the present invention accomplishes all the functions of filling, shielding, and grounding, to avoid corona discharge or the like, as well as relatively uniform grounded or neutral envelope, with ample drain or fault current path (including the safety of many such paths), and also achieves full results of power current return.

A further feature of the invention is that the wrapping of coated, relatively heavy aluminum wires or elements with relatively small spacing between them affords improved safety of underground cable against inadvertent mechanical damage (and disastrous short circuits) by digging or the like. There is insufficient space between the wires for chance penetration by a digging implement, especially in that the coated wires have little or no tendency to spread apart locally during installation. In other words, the present, improved constructions afford a considerable mechanical shield, of good reliability, against instant damage to the main cable by picks or shovels inserted in the ground without cognizance of the existence of the cable.

Finally, substantial advantages of economy are achieved in that the aluminum wires, even adding the cost of semiconductor sheaths, represent less expense than copper shield wires. At the same time, the aluminum wires used with sufficient bulk to provide total electrical conductivity equal to the copper wires of prior arrangement described above (yet at less expense, as stated) present less weight and have other advantages occasioned by their larger diameter as has been explained.

An effective example of the improved cable is illustrated in the accompanying drawings and described below.

DETAILED DESCRIPTION

Figure 2:
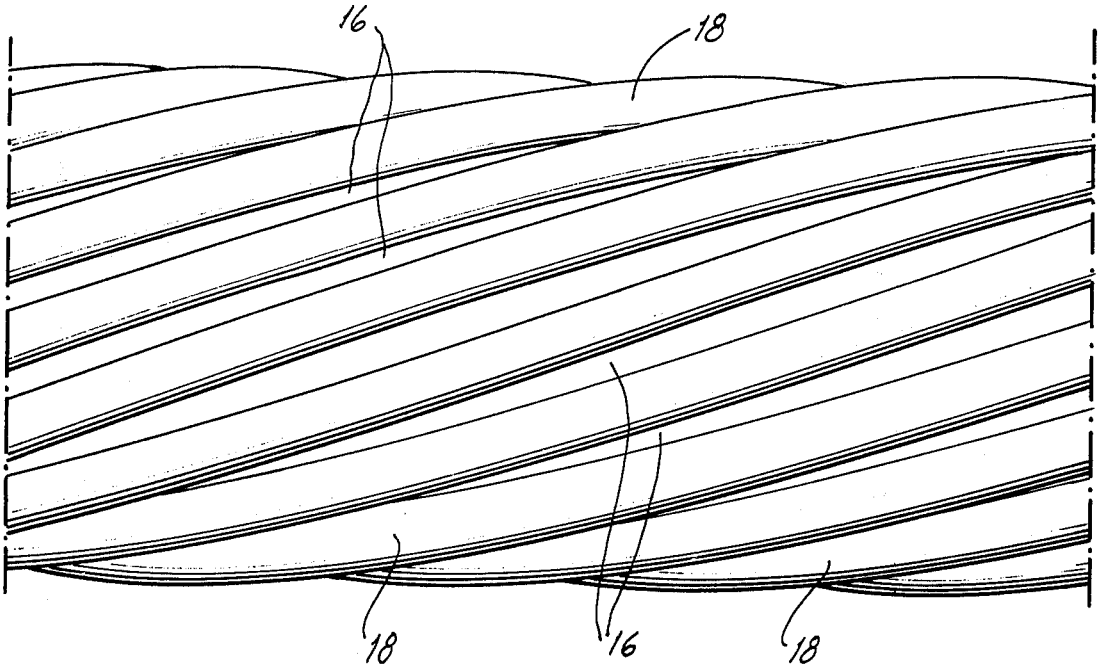
FIG. 2 is a side elevation of the cable.
Figure 1:
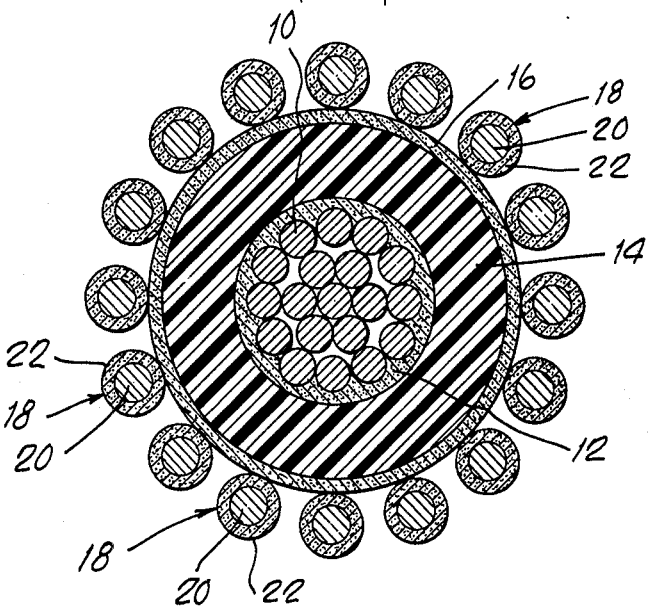
FIG. 1 is a cross section of a cable embodying the invention, shown with the shield wires in section perpendicular to their axes, i.e., disregarding their helical angle of wrapping.

The cable shown in FIGS. 1 and 2 has a central metallic conductor 10 which may be a single solid element but is more often, as here, a multistrand assembly of copper or aluminum. For example, as shown, the conductor may comprise nineteen strands of aluminum wire (e.g., a known alloy of electrical grade), of which the central strand is longitudinally straight and the others, in two layers, are helically wrapped about it in conventional fashion.

Covering the conductor 10, there is a layer 12 of semiconducting material, which not only has substantial thickness around the conductor assembly but, as applied preferably by casting, molding, extrusion, or the like, is in close contact with all exterior surfaces of the conductor assembly, and fills the outermost spaces between adjacent strands.

The described, coated, conductor structure 10–12 is encased by a heavy insulating wall 14, which may, if desired, be applied in similar manner to the layer 12, and preferably consists of a polymer material (e.g., polyethylene or polypropylene) such as commonly employed for insulation of electrical cable. Around the layer 14 and in intimate contact therewith, a further layer 16 of semiconducting material is applied, again, if desired, by molding, casting, or extrusion. The main or basic structure thus constituted by the elements 10 to 16 inclusive represents a shielded power cable wherein the semiconducting material serves the important function of inhibiting corona discharge or the like, with advantages as explained above.

In special accordance with the present invention, the central cable assembly is surrounded by a multiplicity of shield wire elements each generally designated 18 and each individually consisting of an aluminum wire 20 (again, an electrical grade) surrounded by a coating or covering 22 of semiconducting material, which has been pre-applied to the wire, for instance by molding, casting, or extrusion. That is to say, the coated aluminum wire elements 18 are produced conveniently and inexpensively as coated wire, supplied separately and then arranged in suitable helical wrapping around the exterior of the base cable assembly, and particularly around the outside surface of the semiconducting layer 16. Although all parts are effectively shown in FIG. 1, FIG. 2 illustrates the exterior of the cable including the helically wrapped, semiconductor-covered wire elements 18. As will be understood, the angle or pitch of the wire members 18 around the cable may be of any convenient value, appropriate for holding the wires in place with sufficient firmness.

As will be noted, the wire elements 18 are spaced transversely of the cable but advantageously by a spacing which is not appreciably greater (i.e., between the exterior surfaces of adjacent coated strands) than the outside diameter of each strand. This result, as will be understood, is a function of the total number of strands as well as the diameter of each metallic aluminum wire 20 and of its semiconducting sheath 22. Thus in the illustrated cable, there are 16 such wire elements, wrapped as separately made structures, in helical contact around the outermost covering or coating 16 of the cable.

A particularly useful arrangement, and indeed essentially necessary where the cable is to function for a single-phase power circuit as in local distribution, is that the total cross-sectional area of the outer aluminum wires 20, i.e., taken together, should provide electrical conductivity at least about equal to that of the central conductor 10. Where the latter is aluminum, the total area of the wires 20 will be approximately equal to that of the strands constituting the main conductor 10.

In some cases, a cable such as shown in FIGS. 1 and 2 may be employed for 3-phase transmission, and in such event, three complete cables of this sort, including the external wrapping of coated shield wires, may be twisted together or otherwise bunched to provide 3-phase transmission. A customary arrangement of such transmission (e.g., so-called Y connection) is to have a single neutral conductor, which is desirably grounded. Utilizing the cable structures of the present invention, the outer aluminum wires 20 may collectively constitute such grounded neutral, and indeed may be connected together and directly to ground at appropriate terminal regions or intermediate localities along the run of such 3-phase cable.

In such circumstances, where the outer wires 20 constitute collectively the neutral of the circuits, they can be electrically connected together as may be desired. The total conductivity, or current-carrying capacity, of the aluminum wires 20 of each of the three cable assemblies then needs only to be a fraction of the current capacity of each central conductor 10. For reasons of best protection and convenience of manufacture, it may nevertheless be desirable to have the outer wire units 18 of each cable unit include an aluminum conductive element of substantial size, e.g., at or approaching that which would be used in a cable circumstanced for single-phase service.

The results and advantages of the cable structure shown in FIGS. 1 and 2 have been explained hereinabove and are well achieved. In addition to the elements for inhibiting corona discharges and for providing electrostatic shielding (e.g., at the semiconductor layer 16), the assembly of coated aluminum wires 18 realizes various effective functions: in shielding by an essentially conductive layer, in providing transient current drain, and fault current return, in affording a grounded path for the return side of the power circuit, and in mechanical protection, all cooperating to achieve a very reliable cable for high voltage power service.

As stated, the several semiconducting layers may be of any composition suitable for this purpose, such for example as the carbon-loaded polymeric plastic substances now so employed. These are polymers such as polyethylene, polypropylene, or the like, having a relatively heavy filling of fine carbon particles, so that the applied layer or coating has a measure of conductivity, e.g., of higher resistance relative to the metallic conductors, but allows effective drain of electrostatic charges, in contrast to the essentially non-conducting, highly dielectric nature of unfilled or lightly filled polymeric insulation such as employed at 14, i.e., possibly having some particulate content for strength but none sufficient for appreciable conductivity.

By way of specific example, one single-phase power cable such as shown in FIGS. 1 and 2 consisted of a central conductor assembly 10 of 19 wires, each of conductor-grade aluminum wire, twisted in cable configuration. This was surrounded by the described semiconductor layer 12 (0.015 inch minimum thickness), covered with the wall 14, e.g., 0.175 inch thick, of polymer insulation, in turn coated by a further layer 16, 0.030 inch thick, of semiconductor. Each of the 16 outer aluminum wires 20 had a separately applied coating 22 of semiconducting material, e.g., to a thickness of approximately 0.030 inch around each wire. As explained above, the complete cable has distinct superiority, in a number of respects, to a significantly more expensive cable having the same central structure, externally wrapped with 16 bare wires of tinned copper, e.g., of somewhat smaller guage but equal conductivity.

The presently improved cable, having the coated aluminum wires 18, is significantly lighter in weight, yet more effective electrically in the respects described, and is also mechanically superior, e.g., in that the outer wire elements are thicker and, because of their polymeric-type coating, are less likely to slip sidewise. The total cost, moreover, even including such coating, is appreciably less than the copper-wrapped cable.

In one instance of the above example of 15 KV underground cable, where the 16 aluminum shield wires totaled the same gauge (e.g., No. 1/0, American wire gauge) as the 19 wires of the central conductor, the total conductivity of the shield wire assembly could be considered sufficiently equivalent (i.e., at least about equal) to the central conductor, to serve the above-mentioned purpose of ground return for single phase service. As has been stated, in cable designed as an element to be employed in groups of three such elements for three phase service, the total conductivity of the outer shield wires (or their total cross-sectional area) can be less in each element (indeed down to one third) than the conductivity of the central conductor of the element.

A further, special advantage of the invention as compared with cable having an outer wrapping of copper wires is that there is less likelihood of damage to or failure of the basic cable assembly when subjected to high temperatures in use. The coefficient of expansion of copper is much less than that of plastic materials used in the semiconducting and insulating compositions; hence when the temperature rises substantially, such bodies may expand much more than the length of the copper wire, causing the wire to cut or dig into the underlying plastic layers, weakening them or rendering them susceptible of failure. In the present invention, the aluminum (of the outer wires) has a higher coefficient of expansion, and its use in wires of greater cross section and with the semiconducting plastic coating, further cooperates in avoiding such difference in thermal effect between the outer wires and the main insulated and covered cable body as might tend to damage or weaken that body or any of its layers.

It is to be understood that the invention is not limited to the specific features herein shown and described but may be carried out in other ways without departure from its spirit.

I claim:

1. A shielded electric cable comprising:

a. a metallic conductor, b. insulation surrounding said conductor, c. a layer of semiconducting material around said insulation, and d. a multiplicity of separate, coated aluminum wires extending lengthwise of the cable and distributed around the exterior of said semiconducting layer, e. each of said wires having a coating of semiconducting material.

2. A cable as defined in claim 1, in which there are at least 10 such coated wires each carrying a thick layer of semiconducting material and in which there is a layer of such material between the central conductor and the insulation.

3. A cable as defined in claim 1, in which the coated wires are spaced from each other in the circumferentail direction around the cable, the average such spacing between the wires being equal to not more than about the outside diameter of each coated wire.

4. A cable as defined in claim 3, in which there are at least 16 such coated wires each carrying a thick layer of semiconducting material.

5. A cable as defined in claim 1, in which the total cross-sectional area of the aluminum constituted in said wires, collectively, is sufficient to provide electrical conductivity at least about equal to the conductivity of the first-mentioned metallic conductor.

6. A cable as defined in claim 1, in which the total cross-sectional area of the aluminum constituted in said wires, collectively, is sufficient to provide electrical conductivity at least equal to about one third of the conductivity of the first-mentioned metallic conductor.

7. A cable as defined in claim 1, in which there are at least 16 such coated wires each carrying a thick layer of semiconducting material.

8. A cable as defined in claim 7, in which the total cross-sectional area of the aluminum constituted in said wires, collectively, is sufficient to provide electrical conductivity at least about equal to the conductivity of the first-mentioned metallic conductor.

9. A shielded electric cable comprising:

a. a metallic conductor, b. a layer of semiconducting material around said conductor, in contact with its outer surface areas, c. insulation surrounding said layer, d. a second layer of semiconducting material, around said insulation, and e. a multiplicity of separate, coated aluminum wires extending lengthwise of the cable and distributed around the exterior of said second layer, f. each of said aluminum wires being coated with a layer of semiconducting material, g. the number of said coated wires, and the gauge of each and the thickness of the coating layer of each, being such that the coated wires are not separated by average spacing, circumferentially of the cable, which is substantially greater than the outside diameter of each said coated wire.

10. A cable as defined in claim 9, in which there are at least 16 such separate, coated aluminum wires.

11. A cable as defined in claim 9, in which said insulation is a wall of polymeric insulating material in contact with the layer which it surrounds and the layer which surrounds it.

12. A cable as defined in claim 9, in which the coated aluminum wires are wrapped, in elongated helices, around the said second layer of semiconducting material that covers the insulation.

13. A cable as defined in claim 12, in which said insulation is a wall of polymeric insulating material in contact with the layer which it surrounds and the layer which surrounds it.

14. A cable as defined in claim 12, in which the first-mentioned metallic conductor comprises a multiplicity of aluminum wires helically twisted as a unified conductor body.

15. A cable as defined in claim 14, in which the total cross-sectional area of the aluminum constituted in said coated wires, collectively, is about equal to an area in the range from one third to the while of the total cross-sectional area of the aluminum constituted in said wires, collectively, of the metallic conductor.

* * * * *